United States Patent [19]

Murasaki

[11] Patent Number: 4,785,321

[45] Date of Patent: Nov. 15, 1988

[54] IMAGE FORMING APPARATUS

[76] Inventor: Sadanobu Murasaki, 823, Itado, Isehara-Shi, Kanagawa-Ken, Japan

[21] Appl. No.: 86,946

[22] Filed: Aug. 18, 1987

[30] Foreign Application Priority Data

Aug. 21, 1986 [JP] Japan ..... 61-196393

[51] Int. Cl.[4] ..... G03D 3/13

[52] U.S. Cl. ..... 354/321; 354/322; 346/25; 346/108; 355/30

[58] Field of Search ..... 354/90, 91, 300, 319, 354/320, 321, 322, 309, 92, 93; 355/27, 28, 30; 346/25, 108

[56] References Cited

U.S. PATENT DOCUMENTS 4,056,824 11/1977 Iiyama et al. ..... 354/300
4,181,420 1/1980 Blume et al. ..... 355/27

*Primary Examiner*—A. A. Mathews
*Attorney, Agent, or Firm*—Wenderoth, Lind and Ponack

[57] ABSTRACT

Between an image forming unit and an automatic developing unit disposed adjacent to the unit, an intermediate chamber having an exhaust device is provided for transferring a photosensitive material from the image forming unit to the developing unit. Even when the vapors of chemical solutions accommodated in the developing unit for development treatment flow into the intermediate chamber through a clearance created in an outlet opening for delivering the material into the developing unit therethrough, the vapors are prevented from flowing into the image forming unit by being temporarily retained in the chamber and released to an exhaust channel. While the exhaust device promotes the flow of chemical vapors from the developing unit into the intermediate chamber by discharging air from the chamber, the device causes air to flow from the image forming unit into the chamber through a clearance produced in an inlet opening for receiving the material into the chamber therethrough, thereby preventing the vapors from flowing out of the chamber into the image forming unit.

7 Claims, 4 Drawing Sheets

IMAGE FORMING APPARATUS

BACKGROUND OF THE INVENTION

The present invention relates to an image forming apparatus which comprises an image forming unit for forming images on a photosensitive material by exposing the material to light and an automatic developing unit disposed adjacent to the image forming unit for developing the images formed.

So-called home laboratory systems are known which comprise an automatic developing unit and an image forming unit disposed adjacent to the unit.

The automatic developing unit for treating materials sensitized with a silver salt produces chemical-containing vapors since chemical solutions are heated at a high temperature of at least 30° C. for the developing process to achieve a high processing speed. It is desirable to prevent the release of these vapors to the ambient atmosphere in view of environmental hygiene and prevention of corrosion of the devices.

With the home laboratory system, therefore, the automatic developing unit has a cover provided over the development processing chambers therein, or an exhaust device provided in the space above the chambers thus covered.

However, the chemical-containing vapors produced within the developing unit are not always fully discharged into the upper space of the unit since this space communicates with the image forming unit through an inlet opening for receiving therethrough the photosensitive material from the image forming unit. The chemical-containing vapors remaining in the space are also likely to flow into the image forming unit owing to insufficient discharge of the vapors. It is further likely that the vapors will be drawn into the image forming unit from the upper space owing to temporary suction produced when the internal temperature of the image forming unit drops or when the door of this unit is opened outward.

These phenomena cause corrosion to some components of the image forming unit and impair its function. The unit, even if corroded slightly, would not function properly when designed as a precision machine for forming images on a photosensitive material by causing a laser beam to scan in the direction perpendicular to the direction of transport of the material.

The inlet opening for the photosensitive material is generally provided with a pair of transport rollers in pressing contact with each other and is substantially closed with these rollers which are in direct contact with each other or in intimate contact with the photosensitive material nipped therebetween. Nevertheless, no means is provided for sealing off the clearance in the inlet opening around the pair of rollers, while when a photosensitive sheet of small width is passed between the transport rollers, a clearance is inevitably generated between the rollers at the end portion. Consequently, it is impossible to completely prevent the flow of chemical-containing vapors into the image forming unit. This imposes a limitation on the width of photosensitive sheets usable.

SUMMARY OF THE INVENTION

The main object of the present invention is to provide an image forming apparatus which comprises an automatic developing unit for developing a photosensitive material with chemical solutions and in which the vapors of the solutions produced in the unit can be prevented from flowing into an image forming unit adjacent to the developing unit.

Another object of the invention is to provide an image forming apparatus of the type described which has an intermediate chamber disposed between the automatic developing unit and the image forming unit and provided with exhaust means, whereby the vapors of chemical solutions can be fully prevented from flowing from the developing unit into the image forming unit without the necessity of providing effective sealing means for the opening for transferring therethrough a photosensitive material from the image forming unit to the developing unit.

Another object of the invention is to provide an image forming apparatus of the type described wherein the intermediate chamber has an inlet opening for receiving from the image forming unit a photosensitive material with an image formed thereon and an outlet opening for delivering the material into the developing unit, each of the openings being provided with a pair of transport rollers and seal means cooperative therewith, whereby the vapors of chemical solutions can be more effectively prevented from flowing from the developing unit into the image forming unit.

Another object of the invention is to provide an image forming apparatus of the type described wherein the inlet opening of the intermediate chamber is equipped with a shutter which is open while the exhaust means connected to the intermediate chamber is in operation and which is closed while the exhaust means is out of operation, so that the vapors of chemical solutions can be reliably prevented from flowing from the developing unit into the image forming unit even when the exhaust means is not in operation, e.g. when the vapors still remain in the developing unit although the image forming unit is stopped.

Still another object of the invention is to provide an image forming apparatus of the type described wherein the exhaust means is equipped with an exhaust duct through which the air from the intermediate chamber can be discharged at a desired location, for example outside the apparatus, where no problem arises.

These and other objects and features of the invention will become apparent from the following description with reference to the accompanying drawings.

BRIEF DESCRIPTION OF THE DRAWINGS

Throughout the drawings, like parts are designated by like reference numerals.

DETAILED DESCRIPTION OF THE INVENTION

Figure 1:
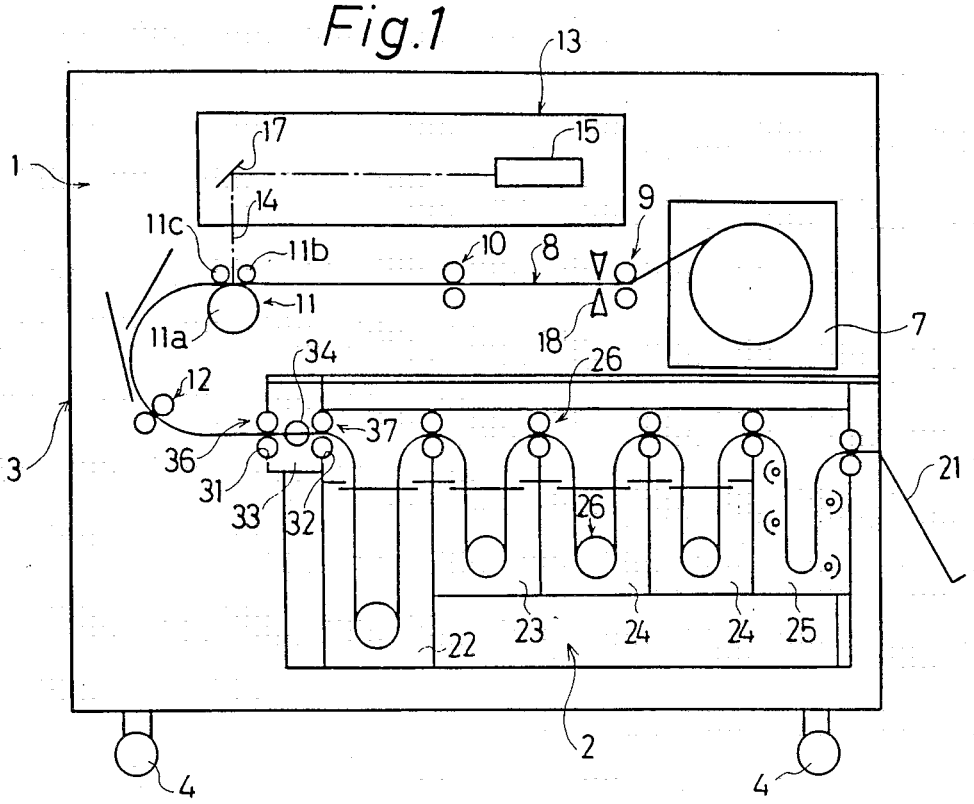
FIG. 1 is a diagram showing the interior construction of an image forming apparatus embodying the invention and comprising a laser image forming unit and an automatic developing unit adjacent to the unit.

The first embodiment of the invention shown in FIGS. 1 to 4 will be described. FIG. 1 illustrates a laser printer of the embodiment comprising a laser image forming unit 1 and an automatic developing unit 2 containing chemicals for a developing process. These units 1, 2 are housed in a main body 3, which is made movable by casters 4. The developing unit 2 is disposed under the image forming unit 1.

The image forming unit 1 is adapted to form an image on a photosensitive material 8, such as film or printing paper sensitized with a silver salt, in the form of a roll, by feeding the material 8 from a supply magazine 7 loaded in the unit 1 and exposing the material 8 to a laser beam 14 emitted from an optical assembly 13 while forwarding the material by transport rollers 9, 10, 11 and 12. The laser beam 14 is emitted from a laser light source 15 based upon an image signal and is guided by a polygon mirror and lenses which are not shown in FIG. 1 and reflected at a reflecting mirror 17, whereupon the beam 14 scans the material 8 at an exposure station in the main scanning direction which is perpendicular to the direction of transport of the material.

Figure 2:
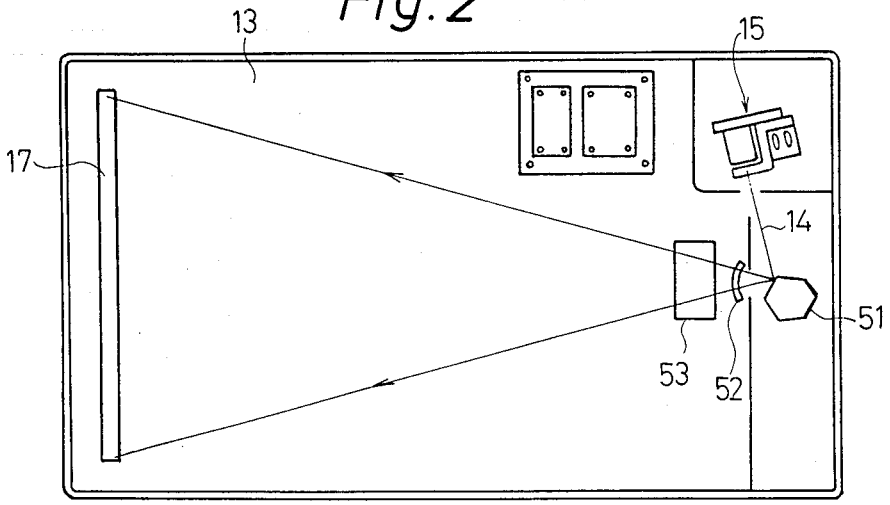
FIG. 2 is an enlarged plan view showing an optical assembly included in the apparatus of FIG. 1.

The operation of the potical assembly 13 will be described in greater detail with reference to FIG. 2. The laser beam 14 is emitted from the light source 15 in accordance with an image signal produced by an unillustrated image signal generator. The laser beam 14 is reflected by a polygon mirror 51 rotating in the direction of arrow a, is passed through a toroidal lens 52 and an $f\theta$ lens 53 and scans the reflecting mirror 17 linearly in the main scanning direction, whereupon the material 8 transporting from the supply magazine to the exposure station is scanned with the beam 14 at the exposure station in the main scanning direction perpendicular to the direction of transport of the material. Thus, an image is formed on the material.

The photosensitive material 8 is scanned with the laser beam 14 in the main scanning direction for image formation while the material is being transported through the exposure station by the transport rollers 11. The transporting condition of the material 8 therefore influences the quality of image to be obtained, so that the material 8 must be transported by the rollers 11 with high precision. It is desirable to arrest the effect of the transport by the transport rollers 9, 10, 12 to the transport by the rollers 11, for example, by driving the pairs of transport rollers 9, 10 upstream from the rollers 11 with respect to the direction of transport, at a transport speed equal to or higher than that of the rollers 11, and driving the pair of rollers 12, downstream from the rollers 11, at a transport speed equal to or lower than that of the rollers 11. The material 8 is then transportable by the rollers 11 without being influenced by the pairs of transport rollers 9, 10 and 12.

The transport rollers 11 at the exposure station comprise a lower roller 11*a* of large diameter and two upper rollers 11*b*, 11*c* both of which have a small diameter and are in pressing contact with the roller 11*a*. While the photosensitive material 8 is transported as nipped between the lower roller 11*a* and the pair of upper rollers 11*b*, 11*c*, the material is transported from the nip of the upper roller 11*b* and the lower roller 11*a* to the nip of the upper roller 11*c* *and the lower roller 11a*, as restrained by these rollers with high precision as required. The material 8 is exposed to the laser beam 14 between the upper rollers 11*b* and 11*c* while thus being transported with high precision.

Such transport roller means may comprise two roller pairs arranged in front and rear of the exposure station, each pair comprising an upper roller and a lower roller. The other pairs of transport rollers 9, 10 and 12 can also be replaced by other transport means.

A cutter 18 for cutting the material 8 is provided upstream of the pair of transport rollers 9 with respect to the direction of transport of the material. When the operator sets the amount of desired size and then operates a print button, the photosensitive material 8 is cut in the desired size by the cutter 18. Thereafter, the cut material 8 is transported to the exposure station.

The automatic developing unit 2 containing chemicals for the developing process therein receives the exposed photosensitive material 8, then automatically develops the material and thereafter discharges the material from the main body 3 onto a tray 21. The unit 2 has in its interior a color developing chamber 22 and a bleaching-fixing chamber 23, and also includes rinsing chambers 24 containing water or the like, a drying chamber 25, etc. for aftertreatment. The material 8 is passed through these chambers one after another for automatic development. For transporting the material 8 through the unit 2, suitable transport means 26 are arranged within the unit 2.

To develop the photosensitive material 8 at a high speed, the treating baths or solutions within the developing unit 2 are usually maintained at a controlled temperature of about 35° C. Accordingly, the treating solutions release vapors within the developing unit 2. When flowing into the image forming unit 1, these vapors cause corrosion to the internal devices to influence the precision transport operation by the rollers 11, while the optical system, if exposed to large amounts of such vapors, will produce obscure images.

Figure 3:
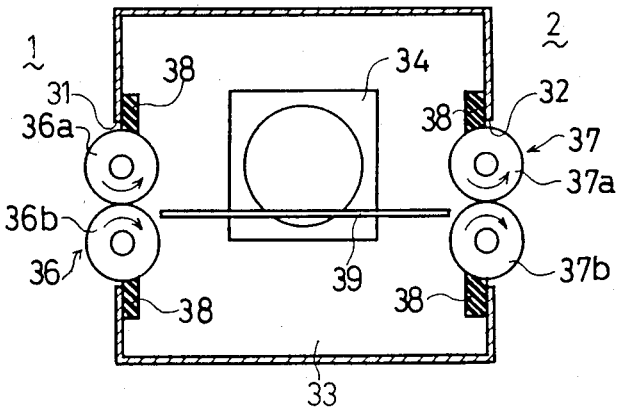
FIGS. 3 and 4 are enlarged views in section showing an intermediate chamber provided with exhaust means and disposed between the two units of the apparatus shown in FIG. 1, FIG. 3 showing the chamber with no photosensitive material passing therethrough, and FIG. 4 showing the chamber while a photosensitive material is being passed therethrough.
Figure 4:
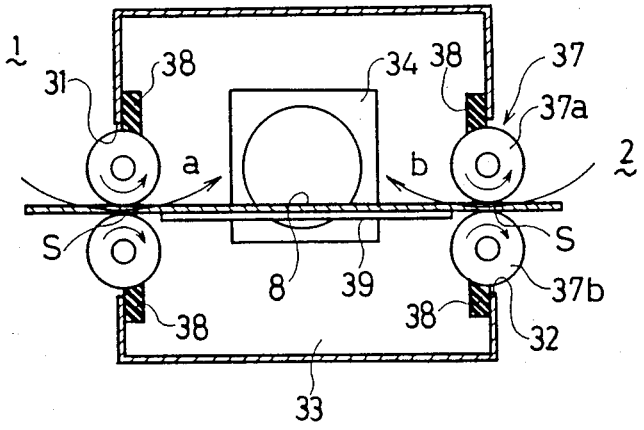
Figure 5:
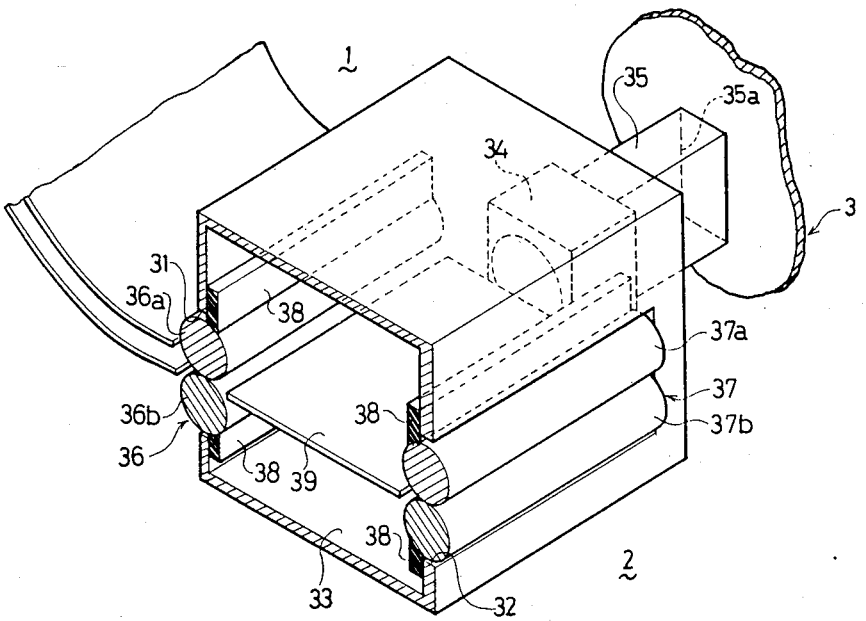
FIG. 5 is a perspective view of FIG. 3.

To obviate these drawbacks, an exhaust chamber 33 is provided adjacent to the automatic developing unit 2 according to the present embodiment. The exhaust chamber 33 has an inlet opening 31 for receiving the image bearing photosensitive material 8 from the laser image forming unit 1 therethrough and an outlet opening 32 through which the material 8 received through the inlet opening 31 is transported to the developing unit 2. As seen in FIGS. 3 to 5, the exhaust chamber 33 further has an exhaust fan 34 connected thereto for discharging the inside air to a desired location outside the main body 3 from an opening 35*a* of an exhaust duct 35 attached to the fan.

The inlet opening 31 disposed at the side of the image forming unit 1 is provided with a pair of feed rollers 36 for transferring the material 8 from the unit 1 into the exhaust chamber 33, while the outlet opening 32 of the exhaust chamber 33 adjacent to the developing unit 2 is provided with a pair of forwarding rollers 37 for sending the material 8 from the chamber 33 into the unit 2. As shown in FIGS. 3 and 5, the roller pairs 36 and 37 comprise upper and lower rollers 36*a*, 36*b*, and upper and lower rollers 37*a*, 37*b*, respectively, in combination. The shafts of the upper and lower rollers 36*a*, 36*b* as well as the shafts of the upper and lower rollers 37*a*, 37*b*, are biased by unillustrated springs to press the opposed rollers into contact with each other.

The inner edges of the chamber side wall defining the inlet opening 31 and opposed to the peripheral surfaces of the upper and lower rollers 36*a*, 36*b* of the feed roller pair 36 are provided with elastic seal plates 38 in intimate contact with these roller surfaces to seal off the inlet opening 31. Elastic seal plates 38 are similarly provided in intimate contact with the upper and lower rollers 37*a*, 37*b* of the forwarding roller pair 37, whereby the outlet opening 32 is sealed off.

The photosensitive material 8, when passing between the upper and lower rollers 36*a*, 36*b* and 37*a*, 37*b*, pushes up the upper rollers 36*a*, 37*a* while pushing down the lower rollers 36*b*, 37*b*. The seal plates 38, which are elastic, do not hinder the upward movement of the upper rollers 36*a*, 37*a* thus pushed, or the downward movement of the lower rollers 36*b*, 37*b*.

The rollers 36*a*, 36*b*, 37*a*, 37*b* may each comprise a rotary shaft provided vertically immovably and an elastic roller body in combination therewith. When thus constructed, the upper rollers 36*a*, 37*a* are compressed upward by the material 8 in travel at the lower portions thereof in contact with the material 8, and the lower rollers 36*b*, 37*b* are compressed downward by the material 8 at the upper portions thereof in contact therewith.

A transport guide 39 is disposed within the exhaust chamber 33 between the roller pairs 36, 37.

The exhaust fan 34 always acts to discharge the air within the exhaust chamber 33 from the main body 3 to the outside. When the sealed portion of the inlet opening 31 or the outlet opening 32 has a clearance, or if the material 8 moves the upper and lower rollers 36*a*, 36, l as well as 37*a*, 37*b*, away from each other and forms a clearance S between each pair of opposed rollers on opposite sides of the material 8 when passing therebetween as seen in FIG. 4, the air in the unit 1 or the air containing the chemical vapors in the unit 2 is forcibly drawn into the exhaust chamber 33 by the fan 34 through the former clearance or the clearance S as indicated by an arrow a or b in FIG. 4, irrespective of the internal pressure of the unit 1 or 2. The air is then discharged outside the main body 3 from the exhaust chamber 33.

Thus, the chemical vapor containing air, even if flowing out from the developing unit 2 through the outlet opening 32, is discharged outside the main body 3 via the exhaust chamber 33. Further even if the inlet opening 31 toward the image forming unit 1 has a clearance, the air in the unit 1 flows into the exhaust chamber 33, and the vapor-containing air flowing out of the unit 2 into the chamber 33 is prevented from further flowing into the unit 1 by this air stream. Consequently, the chemical vapors released in the developing unit 2 is prevented from flowing into the image forming unit 1 adjacent to the unit 2 through the inlet opening 31 for the photosensitive material 8.

Whereas the chemical vapors are likely to remain in the developing unit 2 or will be subsequently released owing to the remaining heat after the two units 1 and 2 are brought out of operation, the exhaust fan 34, if continuously operated for a period of time thereafter, obviates the likelihood of the chemical vapors flowing into the unit 1 in the same manner as above.

Even if the air containing the chemical vapors flows out of the developing unit 2 into the exhaust chamber 33 via the outlet opening 32 while the exhaust fan 34 is held out of operation for one reason or another, the air temporarily remains in the exhaust chamber 33 having the duct 35, is partly released into the duct and is therefore almost completely prevented from flowing into the image forming unit 1 through the inlet opening 31.

In the case where the developing unit 2 is provided with exhaust means, it is still likely that the chemical vapors will leak from the unit 2 into the image forming unit 1, or the unit 1 will exert a withdrawing pressure on the unit 2, causing the chemical vapors to flow out from the developing unit 2 into the image forming unit 1, so that it is advantageous to provide the exhaust chamber 33 also in this case. It is then convenient to serve the exhaust means provided at the developing unit 2 as the exhausta chamber 33.

The color developing chamber 22, bleaching-fixing chamber 23 and rinsing chambers 24 of the developing unit 2 may each be provided with a pump and a pipe for recycling a cleaning liquid therethrough, and also with a drain pipe and a supply pipe for the treating liquid. This facilitates the replacement of the treating liquid on deterioration and the cleaning of the chamber then needed. When desired, the drying chamber 25 may also be so adapted for cleaning.

According to the embodiment described above, the exhaust chamber 33 is provided with the exhaust fan 34. With this embodiment, the chemical vapors released in the automatic developing unit 2 can be prevented from flowing into the image forming unit 1 to some extent even if the exhaust chamber 33 only is provided without the exhaust fan 34. The exhaust fan 34, when provided, nevertheless more effectively prevents the stream of such chemical vapors from flowing into the image forming unit 1.

The second embodiment of the invention shown in FIGS. 6 and 7 will be described next. This embodiment differs from the first in that the inlet opening 31 of the exhaust chamber 33 adjacent to the laser image forming unit 1 is provided with a shutter 41 for closing the inlet opening 31 independently of the pair of feed rollers 36. The shutter 41 is open while the exhaust fan 34 is in operation as seen in FIG. 6 and is closed while the fan 34 is out of operation as shown in FIG. 7.

Figure 6:
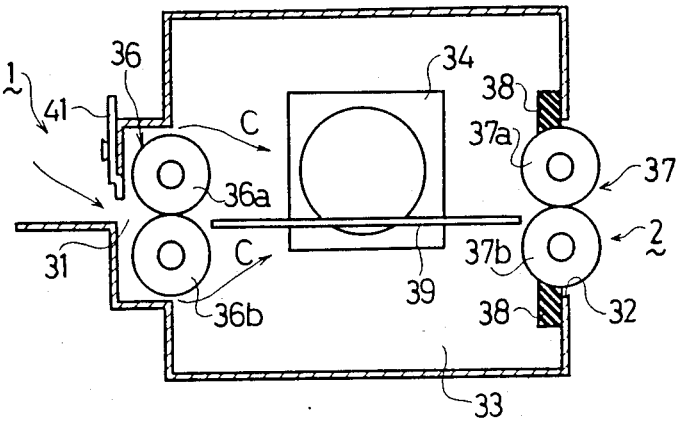
FIGS. 6 and 7 are enlarged sectional views of another intermediate chamber embodying the invention and in the same arrangement as in the first embodiment, the chamber being equipped with exhaust means, FIG. 6 showing the chamber while an exhaust fan is in operation, and FIG. 7 showing the same with the fan out of operation.

When the exhaust fan 34 is operated, the shutter 41 is opened as shown in FIG. 6, causing the fan 34 to positively withdraw air from the image forming unit 1 into the exhaust chamber 33 through the inlet opening 31 as indicated by arrows c. The chemical vapors flowing out of the developing unit 2 into the exhaust chamber 33 through the outlet opening 32 are prevented more effectively than in the first embodiment from flowing into the image forming unit 1 via the inlet opening 31 by the strong air stream thus produced.

Figure 7:
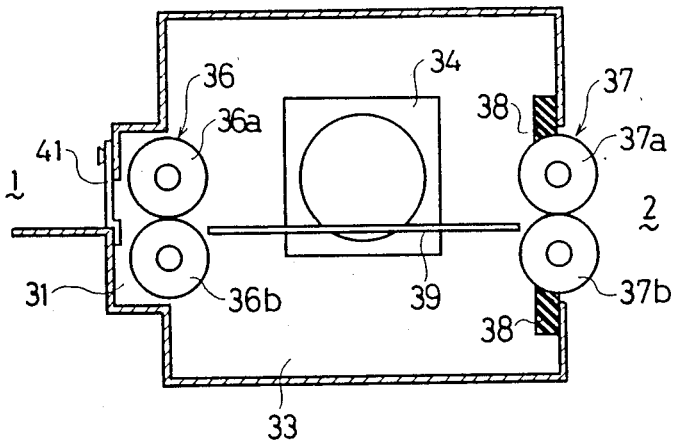

Further when the exhaust fan 34 is stopped, the shutter 41 is closed as seen in FIG. 7 to thereby completely close the inlet opening 31, whereby the chemical vapors, even if flowing out of the developing unit 2 into the exhaust chamber 33, are prevented more effectively than in the first embodiment from flowing into the image forming unit 1 through the inlet opening 31.

What is claimed is:

1. An image forming apparatus comprising:

means for supplying a photosensitive material, image forming means including optical members for forming an image on the supplied photosensitive material by exposing the material to an optical image, developing means containing a liquid developer for developing the photosensitive material having the image formed thereon, an intermediate chamber provided between the image forming means and the developing means, the intermediate chamber having an inlet opening for receiving therethrough the image bearing photosensitive material transported from the image forming means and an outlet opening for delivering the received photosensitive material to the developing means therethrough, exhaust means connected to the intermediate chamber for preventing vapors produced by the liquid developer from flowing into at least the image forming means, and a shutter provided at the inlet opening of the intermediate chamber for opening and closing the inlet opening.

2. An apparatus as defined in claim 1 wherein the shutter is opened when the exhaust means is operated, and is closed when the exhaust means is brought out of operation.

3. An apparatus as defined in claim 1 wherein the inlet opening of the intermediate chamber, is provided with a pair of feed rollers inwardly of said shutter.

4. An apparatus as defined in claim 1 wherein the outlet opening of the intermediate chamber is provided with a pair of forwarding rollers.

5. An apparatus as defined in claim 4 wherein the edge of the respective openings opposed to the peripheral surface of each of the forwarding rollers is provided with an elastic seal member in intimate contact with the peripheral surface.

6. An apparatus as defined in claim 1 wherein the exhaust means comprises a fan.

7. An apparatus as defined in claim 6 wherein the exhaust means comprises an exhaust duct in communication with the outside of the apparatus.

* * * * *

UNITED STATES PATENT AND TRADEMARK OFFICE

CERTIFICATE OF CORRECTION

PATENT NO. : 4,785,321
DATED : November 15, 1988
INVENTOR(S) : Sadanobu Murasaki It is certified that error appears in the above-indentified patent and that said Letters Patent is hereby corrected as shown below:

On the Title page, item [73], Assignee: should read -- Minolta Camera Kabushiki Kaisha, Osaka, Japan --.

Signed and Sealed this

Twenty-eighth Day of June, 1994

*Attest:*

*Attesting Officer*

BRUCE LEHMAN

*Commissioner of Patents and Trademarks*